US005133016A

United States Patent [19]

Clark

[11] Patent Number: 5,133,016

[45] Date of Patent: Jul. 21, 1992

[54] HEARING AID WITH REPLACEABLE DRYING AGENT

[76] Inventor: Wallace Clark, 8140 N. Township Line Rd., #2416, Indianapolis, Ind. 46260-4422

[21] Appl. No.: 670,034

[22] Filed: Mar. 15, 1991

[51] Int. Cl.[5] ..... H04R 25/00

[52] U.S. Cl. ..... 381/69.2; 381/69; 381/68.6

[58] Field of Search ..... 381/69, 69.2, 68.6, 381/68; 429/98, 9, 65

[56] References Cited

U.S. PATENT DOCUMENTS

| | | | |
|---|---|---|---|
| 4,093,105 | 6/1978 | Russell et al. | 220/373 |
| 4,379,988 | 4/1983 | Mattatall | 381/69.2 |
| 4,598,177 | 7/1986 | McGroarty et al. | 381/69.2 |
| 4,756,312 | 7/1988 | Epley | 381/68.6 |
| 4,800,636 | 1/1989 | Topholm | 381/69.2 |
| 4,870,688 | 9/1989 | Voroba et al. | 381/60 |
| 5,062,138 | 10/1991 | Schmid | 381/69.2 |

*Primary Examiner*—Jin F. Ng
*Assistant Examiner*—Huyen D. Le
*Attorney, Agent, or Firm*—Frost & Jacobs

[57] ABSTRACT

A hearing aid worn in the ear and ear canal and provided with a replaceable container of desiccant material. The hearing aid comprises a body containing an electronic sound amplification circuit and an appropriate replaceable power source such as a battery. The body is generally molded of a plastic material and is custom fit to the ear and ear canal in which it is to be worn. The body is provided with at least one port connecting the body interior with the ear canal. The desiccant container is replaceably mounted within the body to maintain the ear canal substantially moisture free to reduce or eliminate moisture induced irritation of the ear canal. The desiccant container is preferably associated with the battery so that both are replaced simultaneously and preferably as a single unit in a single operation.

8 Claims, 2 Drawing Sheets

HEARING AID WITH REPLACEABLE DRYING AGENT

TECHNICAL FIELD

The invention relates to a hearing aid locatable within the ear and ear canal, and more particularly to such a hearing aid provided with a replaceable container of desiccant material to maintain the ear canal substantially moisture-free.

BACKGROUND ART

The present invention is applicable to any hearing aid of the type having at least a part of the hearing aid locatable within the ear canal. While not intended to be so limited, for purposes of an exemplary showing, the invention will be described in its application to that type of hearing aid which is most frequently encountered today, the hearing aid being a completely self-contained unit locatable within the ear and ear canal.

In recent years great improvement has been made in hearing aids due, among other things, to miniaturization Most hearing aids, today, are completely self-contained. In its most usual form a hearing aid comprises a hollow plastic body custom fitted to the ear and ear canal in which it is to be worn. Within the hearing aid body there is located an electronic sound amplification circuit including a speaker. The electronic circuit is powered by a battery such as an air-activated, zinc battery, well known in the art. Such batteries normally have a useful life of from about 15 to about 20 days. While such hearing aids are worn by people of all ages, the preponderance of hearing aid users are senior citizens.

A problem encountered with the use of such hearing aids is the accumulation of moisture in the ear canal. The moisture, in turn, leads to irritation of the ear canal. This moisture induced irritation can be sufficiently unpleasant as to cause hearing aid owners to decline to use them, or to use them only infrequently even in instances where their constant use would be beneficial. The present invention is based upon the discovery that the inclusion of a replaceable container of desiccant or drying agent within the hearing aid body, and the inclusion of at least one opening in the hearing aid body providing communication between the interior of the hearing aid body and the ear canal, will markedly reduce or eliminate this moisture induced irritation.

It will be understood that in order for the replaceable container of desiccant to fit within the hearing aid body, the desiccant container must be quite small, holding only a small amount of the drying agent. As a result, the desiccant container, like the battery, should be changed at regular intervals. While it is within the scope of the invention to have the desiccant container totally separate from the battery and the changing of the desiccant container a wholly separate step from changing the battery, this situation is not preferred. The hearing aid user is readily aware when the battery should be changed since the hearing aid does not function properly with a weak or dead battery. This is not the case, however, with respect to the desiccant which simply must be remembered if the recurrence of irritation is to be avoided. It is thus preferable that a battery and desiccant container be packaged together so that the hearing aid user is reminded to replace both. Even more preferred is a situation wherein the desiccant container is physically associated with the battery so that both are changed at the same time as a single unit in a single operation.

DISCLOSURE OF THE INVENTION

According to the invention there is provided a hearing aid comprising a molded plastic body locatable within the ear and ear canal and custom fit to the ear and ear canal in which it is to be worn. The hearing aid body contains an electronic sound amplification circuit and a replaceable power source such as a battery. The hearing aid body is provided with at least one port which provides communication between the interior of the hearing aid body and the ear canal. A container of desiccant is replaceably mounted within the body to maintain the ear canal substantially free from moisture, to reduce or eliminate moisture induced irritation of the ear canal.

It is preferred that a desiccant container be packaged with a battery as a reminder to the hearing aid user to replace the desiccant container when replacing the battery. In an even more preferred embodiment, the desiccant container is physically associated with the battery so that both are replaced simultaneously as a single unit and in a single replacement operation.

DESCRIPTION OF THE PREFERRED EMBODIMENTS

Figure 1:
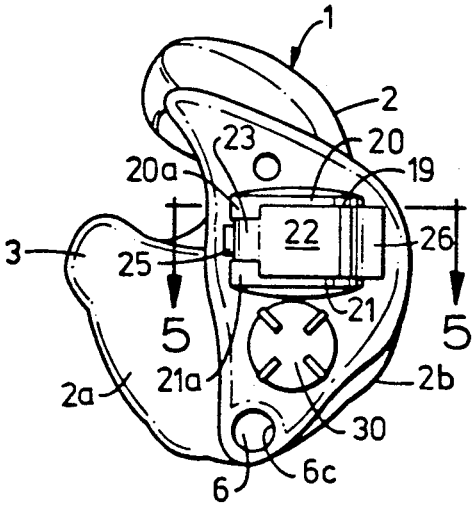
FIG. 1 (PRIOR ART)
FIG. 1 is an elevational view of an exemplary prior art hearing aid of the type to which the present invention is directed and illustrating that side of the hearing aid, a portion of which is exposed at the ear.
Figure 2:
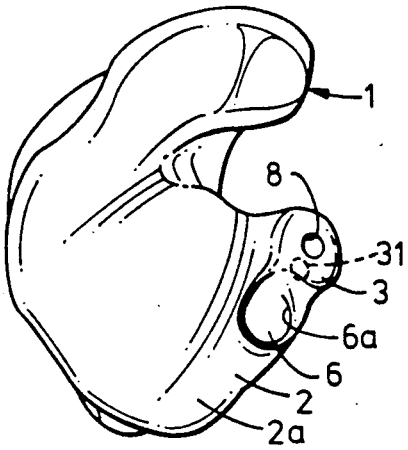
FIG. 2 (PRIOR ART)
FIG. 2 is an elevational view of the prior art hearing aid of FIG. 1, illustrating the opposite side thereof.
Figure 3:
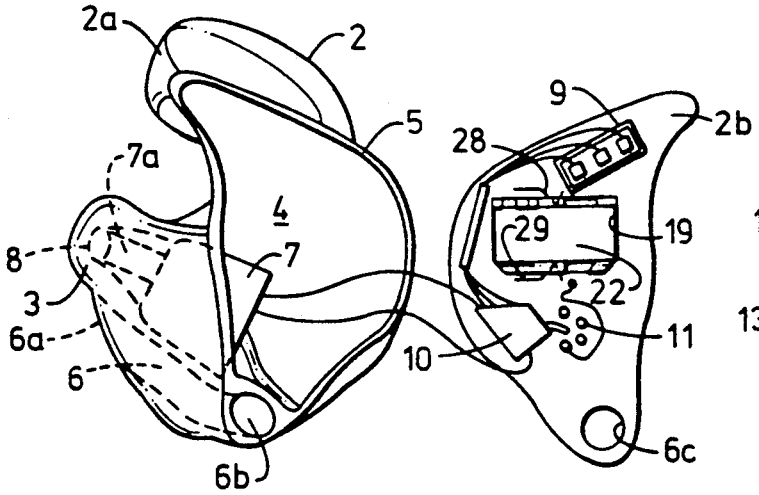
FIG. 3 (PRIOR ART)
FIG. 3 is an elevational view of the prior art hearing aid of FIG. 1 with the first body portion thereof detached from the second body portion.

FIGS. 1, 2 and 3 illustrate an exemplary, prior art, self-contained hearing aid, generally indicated at 1. The hearing aid 1 comprises a body 2 made of plastic material. The body 2 comprises a first part **2*a* and a second part 2*b*, shown in separated condition in FIG. 3. The body 2 has a lobe portion 3 which is adapted to be received in the ear canal. The remainder of the body is engaged in the ear, itself, with the second body portion exposed. The body 2** is generally custom molded to fit the particular ear and ear canal in which it is to be worn.

As will be evident, primarily from FIG. 3, the first body portion **2*a* is hollow, defining an interior chamber 4. The first body portion 2*a* has a substantially planar continuous edge portion 5** to which the second body portion 2*b* is affixed, as by gluing or the like. Thus, the second body portion 2*b* serves as a closure for the chamber 4 of the first body portion 2*a*.

The first body portion 2*a* has a tubular passage 6 extending therethrough. The passage 6 terminates at one end in an opening 6*a* in the lobe 3. The passage 6 terminates at its other end in an opening 6*b*. The body portion 2*b* has an opening 6*c*, corresponding to opening 6*b* and overlying 6*b* when the second body portion 2*b* is affixed to the first body portion 2*a*. When the hearing aid 1 is mounted in the ear and ear canal, the opening 6*a* of passage 6 communicates with the ear canal. The opening 6*b*–6*c* of the passage 6 communicates with the atmosphere. The passage 6 serves as a pressure equalizer, preventing the buildup of pressure in the ear canal upon insertion of the lobe 3 therein, and preventing the creation of a vacuum in the ear canal upon removal of the lobe 3 therefrom.

As indicated above, the hearing aid 1 contains an electronic sound amplification circuit including a speaker. The speaker portion of the circuit is illustrated at 7 in FIG. 3. The speaker 7 has a tubular nose portion 7*a* mounted in a bore 8 leading from the chamber 4 to the exterior of the lobe 3. Elements of the electronic sound amplification circuit are shown in simplified form in FIG. 3 at 9, 10 and 11, mounted on the inside surface of the second hearing aid body portion 2*b*.

Figure 4:
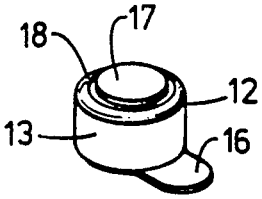
FIG. 4 (PRIOR ART)
FIG. 4 is a perspective view of a typical prior art zinc-air battery.

Further, as is indicated above, the hearing aid 1 is self-contained, being powered by a battery mounted in the hearing aid, itself. An exemplary prior art air-activated, zinc battery is indicated at 12 in FIG. 4. The battery 12 comprises a cylindrical body 13 terminating at one end in a planar contact surface 14 having a pair of pinholes 15 formed therein (see FIGS. 5 and 6). The pinholes 15 permit the entry of air into the battery. Prior to its use, contact surface 14 is provided with an adhesive coated cover closing pinholes 15. The cover is provided with a pull tab 16 (see FIG. 4) by which it may be removed at the time of installation of battery 12 in the hearing aid 1. The other end of the cylindrical battery body 13 terminates in a raised planar contact surface 17. The raised contact surface 17 is of lesser diameter than the body 13, forming an annular shoulder 18.

The second body portion 2*b* of hearing aid body 2 is provided with a rectangular opening 19. The opening 19 is flanked along its longitudinal edges by a pair of upstanding walls 20 and 21 on the outside surface of hearing aid second body portion 2*b*. At one end of rectangular opening 19, the walls 20 and 21 are provided with inturned, opposed, spaced portions 20*a* and 21*a* (see FIG. 1). The portions 20*a* and 21*a* serve as hinge elements, as will be apparent hereinafter.

A cylindrical battery compartment 22 is provided with a hinge element 23. The hinge element 23 is located between wall portions 20*a* and 21*a* (see FIG. 1), and a hinge pin 24 (see FIGS. 5 and 6) extends through all three elements.

Figure 5:
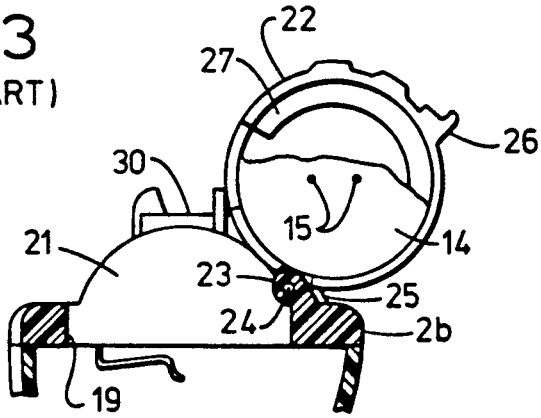
FIG. 5 (PRIOR ART)
FIG. 5 is a fragmentary cross-sectional view taken along section line 5—5 of FIG. 1 and illustrating the mounting of a battery in the pivoted battery compartment.
Figure 6:
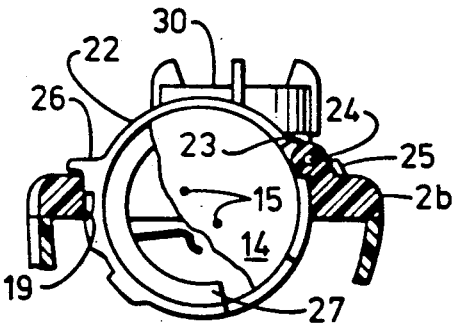
FIG. 6 (PRIOR ART)
FIG. 6 is a fragmentary cross-sectional view, similar to FIG. 5, and illustrating the battery-containing compartment in its closed position.

The above described construction enables the battery compartment 22 to be swingable between an open position illustrated in FIG. 5 and a closed position illustrated in FIG. 6. The open position of battery compartment 22 is determined by an upstanding stop 25 formed on the exterior surface of the second hearing aid body portion 2*b*. The closed position of battery compartment 22 is determined by a lug 26 extending from the battery compartment and engaging the outer surface of hearing aid second body portion 2*b* when the battery compartment 22 is in its closed position. The lug 26 is so configured that it can be engaged by user's fingernail or an appropriate tool, to shift battery compartment 22 from its closed to its open position.

The cylindrical battery compartment 22 has an internal diameter such as to just nicely receive the cylindrical body 13 of battery 12. At one side, battery compartment 22 is provided with an annular flange 27. When the battery 12 is mounted in the battery compartment 22, the annular flange 27 engages the shoulder 18 of the battery. The annular flange 27 also defines an opening through which the planar contact surface 17 extends.

To install battery 12, it is only necessary to pivot the battery compartment 22 to its open position shown in FIG. 5. Battery 12 is then inserted in battery compartment 22 until the battery shoulder 18 abuts the battery compartment flange 27. At this point, the battery compartment is shifted to its closed position illustrated in FIG. 6 and the battery is maintained captive therein. In FIG. 3, the battery compartment 22 is shown partially open. When a battery 12 is mounted in the compartment 22, and the compartment 22 is shifted to its closed position, a wire contact 28 will engage the contact surface 14 of battery 12 and a wire contact 29 will engage the contact surface 17 of battery 12.

The prior art hearing aid of FIGS. 1–6 is completed by the provision of a rotatable volume adjustment knob 30 (see FIG. 1). The volume adjustment knob is exposed when the hearing aid is mounted in the ear and ear canal, so that the user can readily adjust the volume manually.

According to the present invention, a container of desiccant material is located within chamber 4 of the hearing aid 1. The purpose of the desiccant material is to maintain the ear canal, inwardly of lobe 3, free of irritation inducing moisture. To this end, there must be provided an adequate air passage between the chamber 4 and the ear canal. This may be accomplished by enlarging the passage 8, or by providing an additional passage. Such an additional passage is shown in broken lines at 31 in FIG. 2.

Any appropriate desiccant material, such as activated carbon, may be used, so long as it is not irritating to the skin. Similarly, any appropriate desiccant container can be used so long as it is replaceably mountable within the chamber 11. For example, the desiccant container could be of the same general size and shape as battery 12, and could be provided with its own mounting compartment similar to compartment 22. In such an instance, it is up to the hearing aid wearer to remember to periodically change the desiccant container, preferably at the time of battery change. To assist in reminding the hearing aid wearer, a desiccant container could be packaged with each battery.

An exemplary desiccant container is taught in U.S. Pat. No. 4,093,105. The teachings of this patent are incorporated herein by reference. Briefly, the patent teaches a cylindrical container having a planar bottom and an open top. The patent further teaches a cap comprising a planar top and an annular skirt. The cylindrical container is of lesser diameter near its open top. This portion of lesser diameter is engaged by the skirt of the cap with a snap fit. The skirt portion of the cap and the main portion of the container have the same exterior diameter. The desiccant container is completed by the provision of a plurality of tiny holes in the planar top surface of the cap and the planar bottom surface of the container. The reference teaches that the holes are shaped as truncated, square pyramids having their smaller area ends at the outer surfaces of the top and bottom and their larger area ends at the inner surfaces thereof. The shape of the holes prevents the desiccant, even in granular form, from leaving the container since the granules merely become jammed or wedged in the small holes. Gasses and vapors, on the other hand, can pass through the holes even when filled with desiccant granules.

Figure 7:
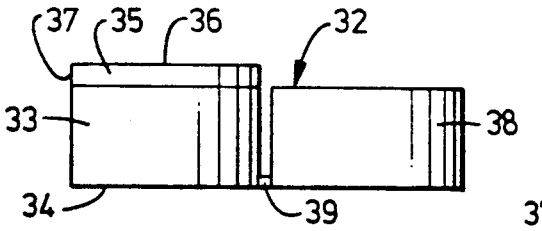
FIG. 7 is a side elevational view of a desiccant container and battery holder of the present invention.
Figure 8:
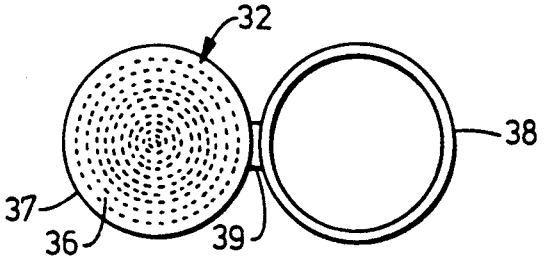
FIG. 8 is a bottom view of the desiccant container and battery holder of FIG. 7.

FIGS. 7 and 8 illustrate a preferred embodiment of desiccant container according to the present invention. The structure is generally indicated at 32 and comprises a cylindrical container 33 having a planar bottom 34. The container 33 is provided with a cap 35 having a planar top 36 and a cylindrical skirt 37. The cap 35 may engage the container 33 with a snap fit and the outer diameters of the skirt 37 and the container 33 may be identical. The container 33 is loaded with any appropriate desiccant material such as activated carbon. The outer diameter of the container 33 and cap 35 and the axial dimension of these elements approximates maximum outer diameter and axial dimension of the battery 12.

The structure 32 additionally includes a cylindrical rim 38. The axial dimension of rim 38 is equivalent to the axial dimension of large diameter portion of battery 12. The rim 38 is thin walled and has an internal diameter such as to just nicely receive the battery 12. The rim 38 is attached to and spaced from container 33 by an interconnecting lug 39.

Figure 9:
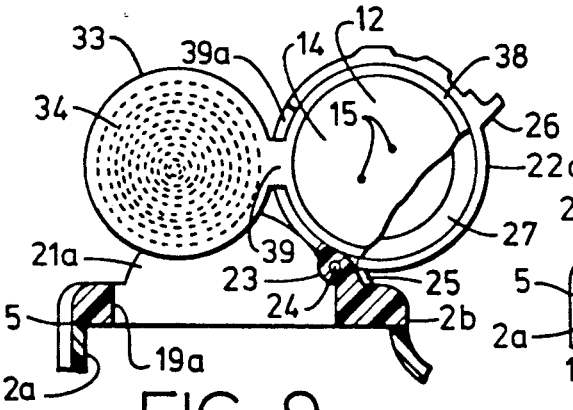
FIGS. 9-13 illustrate, step-by-step, the mounting of the desiccant container and battery holder of FIGS. 7 and 8 in a hearing aid.

FIG. 9 is a cross-sectional view similar to FIG. 5. FIG. 9 illustrates the second body portion **2*b* of hearing aid 1. The second body portion 2*b* has been modified only in that the rectangular opening 19*a* is slightly longer than the rectangular opening 19 of FIG. 5. It will be understood that the second hearing aid body portion 2*b* is again provided on its exterior surface with a pair of walls equivalent to walls 20 and 21. One such wall 21*a* is shown in FIG. 9. The wall 21*a* differs from the wall 21 of FIG. 5 only in that it is slightly larger to accommodate for the length enlargement of opening 19*a***.

The embodiment of FIG. 9 is provided with a hinged battery compartment **22*a* substantially identical to the battery compartment 22 of FIG. 5. To this end, the battery compartment 22*a* is provided with a hinge element 23 and a hinge pin 24. The battery compartment 22*a* is also provided with the lug 26 which determines its closed position and by which it can be opened. Finally, the battery compartment 22*a* is provided with an annular rim 27 equivalent to the rim 27 of FIG. 5**.

The battery compartment **22*a* of FIG. 9 differs from the battery compartment 22 of FIG. 5 only in that it is of slightly larger external and internal diameters. The internal diameter of battery compartment 22*a* is such that it will receive the rim 38 of the desiccant container structure with clearance sufficient to enable the rim 38 to be rotatable within the battery compartment 22*a***.

In FIG. 9, the battery compartment **22*a* is shown in its open position, as determined by stop 25. In FIG. 9, rim 38 of the container structure 32 has been inserted in battery compartment 22*a* with the adjacent end of the rim 38 abutting annular flange 27. Further, a battery 12 has been mounted in rim 38 with the battery shoulder 18 also abutting annular flange 27. It will be apparent from FIG. 9 that the space between the container 33 and rim 38 is sufficient to receive the wall of battery compartment 22*a*** therebetween.

Figure 10:
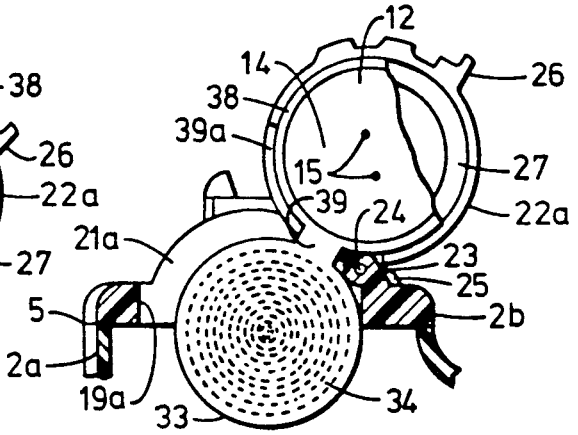
Figure 11:
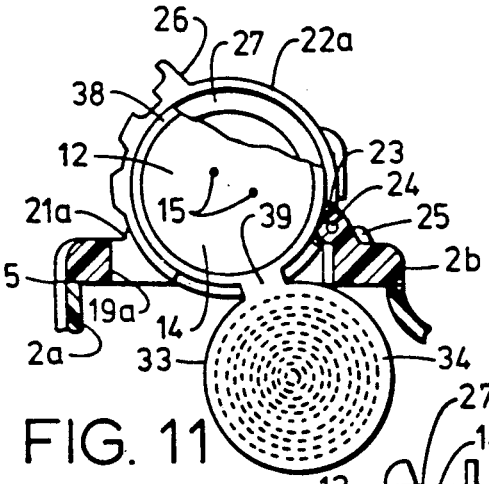
Figure 12:
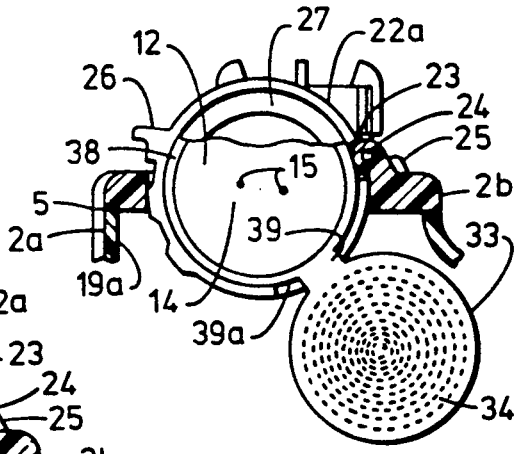
Figure 13:
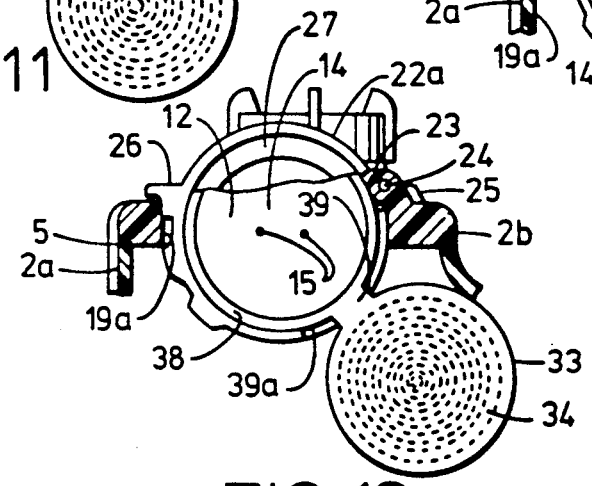

Once the rim 38, and the battery 12 have been mounted in battery compartment **22*a*, it is only necessary to shove downwardly on container 33, causing counterclockwise rotation of the rim 38 within battery compartment 22*a*. As is indicated in FIG. 9, this will cause container 33 to enter between the wall 21*a* and its counterpart (not shown) on the other side of rectangular opening 19*a*. Further downward pressure on container 33 will cause it to achieve the position illustrated in FIG. 10. At this point, the battery compartment 22 is engaged by the finger of the wearer and is caused to rotate in a counterclockwise direction as is shown in FIGS. 11 and 12 until the battery compartment 22*a* achieves its fully closed position as shown in FIG. 13. When the battery compartment 22*a* achieves its fully closed position, the battery 12 will be engaged by contacts 28 and 29, as described above. Furthermore, the desiccant container 33 will be located within chamber 4 of the hearing aid 1. The rim 38 is provided with a notch 39*a* to accommodate lug 39 during rotation of the rim 38 in the battery compartment 22*a***.

Depending upon customized shape of the first body portion **2*a* of hearing aid 1, it may be necessary to elongate the body portion adjacent the edge portion 5 to which hearing aid body portion 2*b* is attached. This, in essence, slightly enlarges the chamber 4 to accommodate the desiccant container 33**.

It will be evident from the above description that the desiccant container embodiment of FIGS. 7 and 8 can be packaged with a battery. In fact, the battery can be mounted within rim 38 in the package. Since the desiccant container 33 is physically associated with the battery 12, the desiccant container 33 will automatically be changed each time a battery is changed in a single simple operation.

Modifications may be made in the invention without departing from the spirit of it.

What is claimed is:

1. A hearing aid comprising a hollow body locatable within the ear and ear canal of the user, said hearing aid body containing an electronic sound amplification circuit and a replaceable battery therefore, said hearing aid body being provided with at least one port providing communication between the interior of said hollow body and said ear canal, and a container of desiccant material replaceably mountable within said body, whereby to maintain said ear canal substantially free of moisture to reduce moisture induced irritation within said ear canal.

2. The hearing aid claimed in claim 1 wherein said desiccant container is physically associated with said battery so that both are replaceable simultaneously in a single replacement operation.

3. The hearing aid claimed in claim 1 including an opening in said hearing aid body, a battery compartment having a cylindrical battery receiving chamber therein, a conventional cylindrical hearing aid battery, said battery compartment being affixed to said hearing aid body adjacent said opening, said battery compartment being pivotable between an open position wherein said chamber is wholly outside said hearing aid body for mounting and replacement of said battery within said battery compartment chamber and a closed position wherein a portion of said battery compartment chamber extends through said opening and within said hearing aid body and said battery within said chamber is positioned to energize said circuit.

4. The hearing aid claimed in claim 3 wherein said container for desiccant material comprises a hollow body and closed ends, one of said ends being removable for loading desiccant material within said container body, said ends having perforations therethrough so sized as to permit the passage of aid therethrough and to prohibit the passage of said desiccant material therethrough, said desiccant container being so sized as to be shiftable through said opening in said hearing air body, a cylindrical rim, said rim having an interior diameter sized to receive said hearing aid battery, said rim being held in spaced side-by-side relationship to said desiccant container by a lug extending between adjacent ends of said rim and said desiccant container, said cylindrical chamber of said battery compartment being of such diameter as to receive said rim and battery therein, said rim being rotatable within said battery compartment chamber, whereby when said battery compartment is in said open position, said desiccant container is outside said hearing aid body, and when said battery compartment is in said closed position said desiccant chamber is wholly within said hearing aid body.

5. The hearing aid claimed in claim 4 wherein said desiccant container, lug and rim comprise an integral, one-piece structure.

6. The hearing aid claimed in claim 1 wherein said container for desiccant material comprises a hollow body and closed ends, one of said ends being removable for loading desiccant material within said container body, said ends having perforations therethrough so sized as to permit the passage of air therethrough and to prohibit the passage of said desiccant material therethrough.

7. A replaceable battery and desiccant material container assembly for use within the hollow body of a hearing aid of the type being locatable within the ear and ear canal of the user to energize said hearing aid and to remove moisture from said ear canal to reduce moisture induced irritation thereof, said desiccant material container of said assembly comprising a cylindrical body and closed ends, one of said ends being removable for loading desiccant material within said container body, said ends having perforations therein so sized as to permit the passage of air therethrough and to prohibit passage of said desiccant material therethrough, a conventional cylindrical hearing aid battery, a cylindrical rim having an interior diameter sized to receive said hearing aid battery, said battery being located within said rim, said rim being held in spaced side-by-side relationship with said desiccant material container by a lug extending between adjacent ends of said rim and said desiccant container.

8. The replaceable battery and desiccant material container assembly claimed in claim 7 wherein said desiccant material container, said lug and said rim comprise an integral, one-piece structure.

* * * * *

UNITED STATES PATENT AND TRADEMARK OFFICE

CERTIFICATE OF CORRECTION

PATENT NO. : 5,133,016

DATED : July 21, 1992

INVENTOR(S) : Wallace Clark

It is certified that error appears in the above-identified patent and that said Letters Patent is hereby corrected as shown below:

Column 7 - Claim 4 - Line 3 - "aid" should be deleted and replaced with --air--

Column 7 - Claim 4 - Line 6 - "air" should be deleted and replaced with --aid--

Signed and Sealed this

Nineteenth Day of October, 1993

*Attest:*

Bruce Lehman

BRUCE LEHMAN

*Attesting Officer*

*Commissioner of Patents and Trademarks*